United States Patent [19]

Kalishman

[11] Patent Number: 4,583,630

[45] Date of Patent: Apr. 22, 1986

[54] COIN CHUTES FOR A COIN APPARATUS

[76] Inventor: Bernard Kalishman, 19430 NE. 23rd Ave., North Miami Beach, Fla. 33180

[21] Appl. No.: 654,221

[22] Filed: Sep. 25, 1984

[51] Int. Cl.[4] ..... G07F 1/04

[52] U.S. Cl. ..... 194/227; 194/344

[58] Field of Search ..... 194/1 K, 1 L, 1 G, DIG. 4, 194/DIG. 2, 22, 45, 48, 94

[56] References Cited

U.S. PATENT DOCUMENTS 2,935,170 5/1960 Holstein et al. ..... 194/94 X

*Primary Examiner*—Stanley H. Tollberg

*Attorney, Agent, or Firm*—Gilbert L. Wells

[57] ABSTRACT

Coin apparatus having coin chutes for nickels, dimes and quarters with a totalizer activated by a pivoted trip wire having a finger extending across the coin chutes is modified to accept an increased total value of coins. This modification is brought about by changing the paths of the coin chutes so that the coins index a fewer number of increments on the totalizer for each coin.

8 Claims, 6 Drawing Figures

COIN CHUTES FOR A COIN APPARATUS

BACKGROUND OF THE INVENTION

The field of the invention is Check-Controlled Apparatus and the present invention is an improvement in the coin chutes used in a check-rotated wheel apparatus.

The state of the art of the coin apparatus of the present invention may be ascertained by reference to U.S. Pat. Nos. 2,991,867; 3,053,370; and 3,054,493, of James T. Schuller, the disclosures of which are incorporated by reference herein.

With particular reference to U.S. Pat. No. 2,991,867, prior art coin chutes are shown in FIGS. 7 through 9. The present invention is an improvement over the coin-actuated totalizing function of U.S. Pat. No. 2,991,867, wherein the amount of coins deposited in a vending machine is totalized by modifying the coin chutes of FIGS. 7 to 9.

U.S. Pat. No. 2,991,867 has a coin totalizer unit which includes an arm constituted by a trip wire pivoted to swing on an axis of a shaft and having a finger at its free end which extends across three coin chutes for nickels, dimes and quarters, respectively. These coin chutes are held in a coin chute assembly and the assembly is mounted on a plate.

The arrangement of U.S. Pat. No. 2,991,867 is such that a coin dropping in any one of the coin chutes swings the trip wire down from its raised retracted position through an angle corresponding to the value of the coin. The coin then escapes from the trip wire, the wire swings back up to its raised retracted position, and on its upward swing it acts to index a stop means forward (rotate it counter-clockwise) a number of steps corresponding to the value of the coin. A nickel indexes the stop means forward one step, a dime indexes the stop means forward two steps, and a quarter indexes the stop means forward five steps.

The stop means of the totalizer unit of U.S. Pat. No. 2,991,867 has markings spaced at intervals corresponding to the spacing of the ratchet teeth and representing prices from five cents to sixty cents in five cent increments.

More recent models of the coin apparatus of U.S. Pat. No. 2,991,867, which are particularly used in cigarette vending machines, have a stop means of the totalizer having spacings representing prices up to $1.40, in twenty-eight increments or twenty-eight clicks of the ratchet.

Because of inflation, particularly in cigarettes, the upper limit of $1.40 is not a sufficient coin capacity to accommodate price rises above $1.40.

SUMMARY OF THE INVENTION

Having in mind the current limit on vending machines to a maximum of $1.40 for twenty-eight increments on the stop means of the totalizer, it is an object of the present invention to increase the coin capacity of vending machines without increasing the number of increments of the stop means.

This object is achieved by blocking off the nickel chute and changing the path of the dime and quarter chutes so that the dime chute indexes the stop means one increment per dime, and the quarter chute indexes the stop means three increments per quarter.

Now for a stop means and totalizer having twenty-eight increments, the capacity will be $2.35 instead of $1.40. In the case of U.S. Pat. No. 2,991,867, having a limitation of $0.60 and twelve increments, the capacity will be increased to $1.00.

This increase in capacity is achieved with only the minor alteration of the vending machine wherein the nickel chute is blocked and the dime and quarter chutes are replaced.

BRIEF DESCRIPTION OF THE DRAWINGS

The present invention is further explained by reference to the appended drawings, as follows.

DESCRIPTION OF THE PREFERRED EMBODIMENTS

Figure 1:
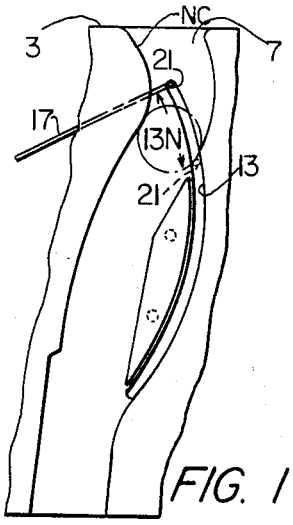
FIG. 1 PRIOR ART
FIG. 1 is a vertical section showing the nickel chute of U.S. Pat. No. 2,991,867.

With particular reference to prior art FIGS. 1 to 4, it is shown that the coin chute assembly 3 extends down from the top of the main plate 1 adjacent the right side flange 5 of plate 1. The dime chute DC of assembly 3 is located between the nickel chute NC and the quarter chute QC, the quarter chute being on the inside of the dime chute toward plate 1, the nickel chute being on the outside of the dime chute away from plate 1. The coin chute assembly 3 comprises a casting 6 formed with a groove on one side thereof forming the quarter chute QC and a casting 7 formed with grooves on opposite sides thereof forming the dime and nickel chutes. A plate is provided between castings 6 and 7 serving as a partition between the quarter and dime chutes, and a cover plate 11 is provided overlying the outside of casting 7 serving as the outside wall of the nickel chute. Each of the castings 6 and 7 and the plates 9 and 11 is made with an arcuate slot so as to provide an arcuate slot 13 through the entire assembly 3. This slot registers with the nickel chute NC from the upper end of the slot through a position 13N of the slot having a length approximately one-fifth the entire length of the slot. It registers with the dime chute DC from its upper end through a portion 13D of its length, 13D being approximately twice as long as 13N. It registers with the quarter chute QC throughout its entire length. The coin chute assembly 3 is held together and secured to plate 1 by means of bolts, with a space between plate 1 and assembly 3 to accommodate the trip wire 17. The upper ends of the coin chutes are open.

The trip wire 17 is pivoted to swing on an axis of a shaft having a finger 21 at its free end which extends across the three coin chutes NC, DC and QC of the coin chute assembly 3.

It will be understood that the prior art vending machine has a slot for nickels, dimes and quarters. Coins deposited in this slot enter a coin selector and slug rejector device located above the coin chute assembly 3 to deliver nickels to the nickel chute NC, dimes to the dime chute DC, and quarters to the quarter chute QC. The coin selector and slug rejector device also acts to reject coins of improper denominations (pennies) and spurious coins. Coin selector and slug rejector devices suitable for the purpose are well known; see, for example, U.S. Pat. No. 2,292,628.

Figure 2:
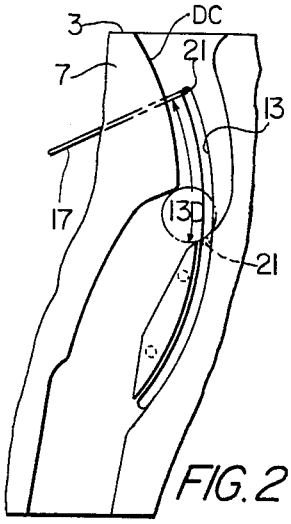
FIG. 2 PRIOR ART
FIG. 2 is a vertical section showing the dime chute of U.S. Pat. No. 2,991,867.
Figure 5:
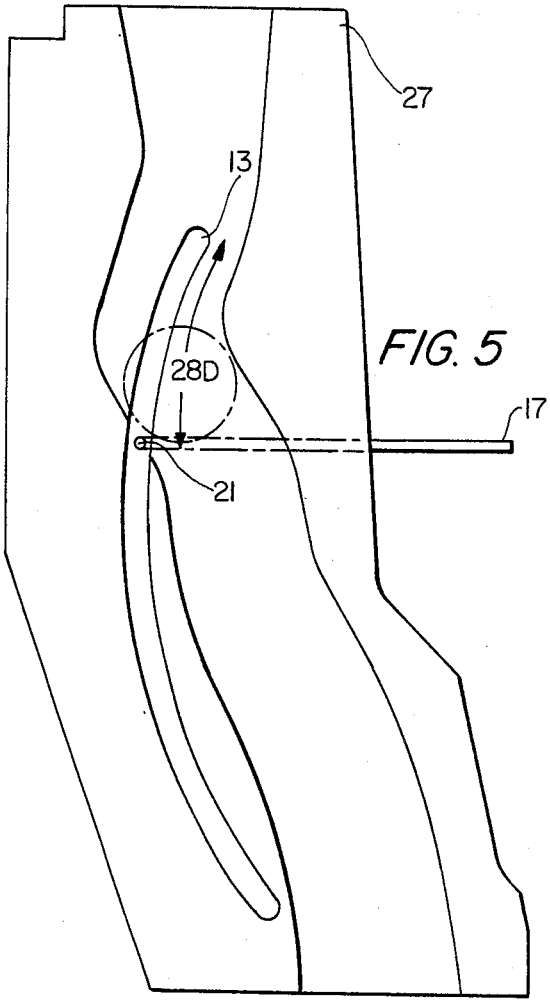
FIG. 5 is a vertical section showing the modified coin chute path for dimes as in the present invention.

In the present invention, the nickel chute is blocked off and the path of the dime chute is modified to be similar to the path of the prior art nickel chute wherein only one increment is indexed on the ratchet as shown in FIG. 5. FIG. 5 shows casting 27 with the dime side as shown in FIG. 2 modified to produce only one increment of indexing as each dime passes therethrough. As shown in FIG. 5 the chute is formed so that the distance that a dime 28D travels while in contact with finger 21 is equal to the distance that a nickel previously travelled while in contact with finger 21. The distance travelled by finger 21 is one fifth the length of arcuate slot 13.

Figure 3:
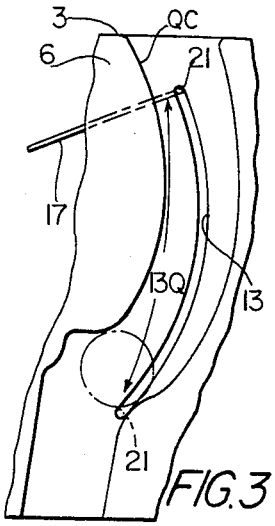
FIG. 3 PRIOR ART
FIG. 3 is a vertical section showing the quarter chute of U.S. Pat. No. 2,991,867.
Figure 4:
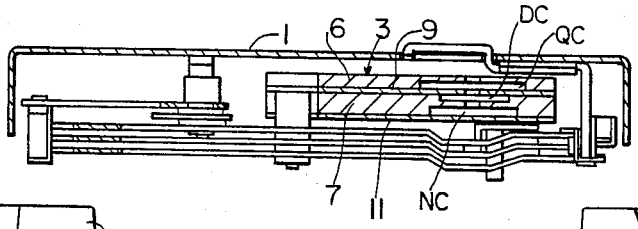
FIG. 4 PRIOR ART
FIG. 4 is a horizontal cross-section showing the assembly of the coin chutes of FIGS. 1 through 3.
Figure 6:
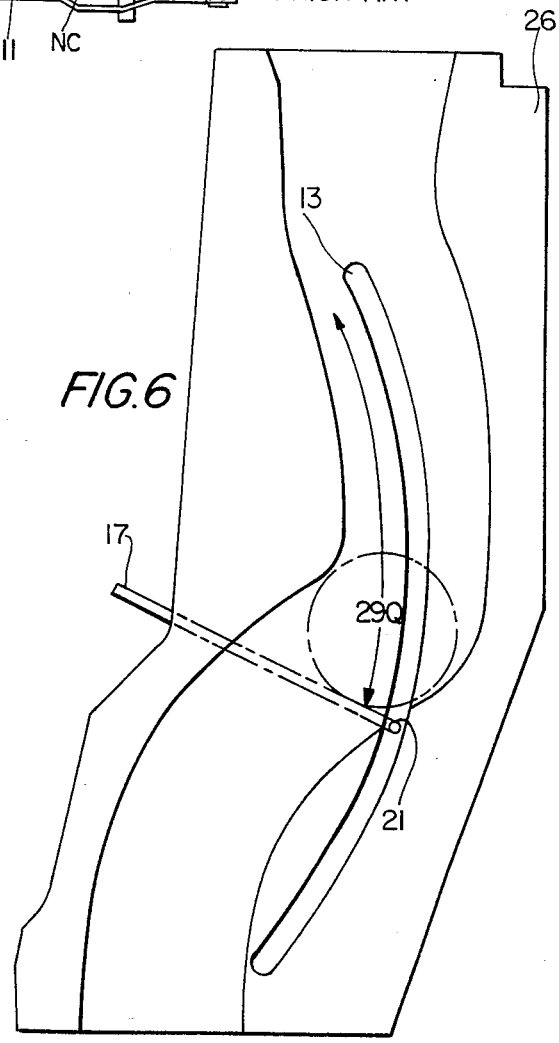
FIG. 6 is a vertical section showing the modified coin chute path for quarters as in the present invention.

FIG. 6 shows casting 26 with the quarter chute of FIG. 3 modified to produce three increments of indexing as each quarter passes therethrough. The chute of FIG. 6 is formed so that a quarter 29Q moves finger 21 a distance equal to three fifths of the length of arcuate slot 13 and this distance is equal to three increments of indexing before the quarter leaves the finger.

BEST MODE OF CARRYING OUT THE INVENTION

According to the present invention, state of the art cigarette vending machines having coin chutes like those of FIGS. 1 to 3 are modified by the replacement with the modified castings shown in FIGS. 5 and 6. The nickel slot on the other side of FIG. 5 is blocked. These state of the art cigarette vending machines have twenty-eight increments on the totalizer and are limited to $1.40.

With the present modification, the totalizer can be set for twenty-eight increments and this will permit the insertion of 9 quarters and one dime, which gives a total of $2.35.

Of course, one could insert twenty-eight dimes for a total of $2.80, but this would be a loss of $0.45 to the customer. It is, therefore, necessary to post the number and value of coins needed for the item. Therefore, for $2.35, it would be necessary to post nine (9) quarters and one dime.

As a further illustration for a pack of cigarettes valued at $1.70, it would be necessary to set the totalizer for twenty increments and post six (6) quarters and two (2) dimes.

What is claimed is:

1. In a coin apparatus comprising a feeler normally occupying a retracted position and movable away from retracted position, an indexing stop movable away from a retracted position in which it is engageable by the feeler to limit movements of the feeler to a position in which it allows a full stroke of the feeler, said stop being biased to return to retracted position, coin-actuated means for advancing said stop in amounts proportional to coin values, means for holding the stop in advanced position against the return bias, and means for releasing the stop for return under the bias to its retracted position, said coin-actuated means comprising a plurality of coin chutes having a coin path with a trip wire pivoted to swing on an axis and having a finger at its free end extending across said coin chutes wherein a coin dropping in one of said chutes swings said trip wire through a given angle corresponding to the value of said coin and, upon return, indexes said indexing stop, the improvement comprising: means for minimizing the value of said given angle whereby the values of said coins and said indexes are reduced.

2. The coin apparatus of claim 1, where said means for minimizing comprises said coin path having a shorter path.

3. The coin apparatus of claim 2, wherein said shorter path is equivalent to the path of a nickel when a dime is used.

4. The coin apparatus of claim 2, wherein said shorter path is equivalent to the path of three nickels when a quarter is used.

5. The coin apparatus of claim 2, having only coin chutes for dimes and quarters and said dime chute has a path equivalent to a nickel and said quarter chute has a path equal to three nickels.

6. The coin apparatus of claim 5, wherein said given angle is defined by an arcuate slot having a given length.

7. The coin apparatus of claim 6, wherein said dime chute is one fifth of said given length of said slot.

8. The coin apparatus of claim 7, wherein said quarter chute is three fifths of said given length of said slot.

* * * * *